US007857606B2

(12) United States Patent
Chiu et al.

(10) Patent No.: US 7,857,606 B2
(45) Date of Patent: Dec. 28, 2010

(54) VARIABLE DISPLACEMENT PUMP

(75) Inventors: Charles Chiu, Yongkang (TW); Lon Chen, Tainan (TW); Jo Chen, Tainan County (TW)

(73) Assignee: JI-EE Industry Co., Ltd. (TW)

( * ) Notice: Subject to any disclaimer, the term of this patent is extended or adjusted under 35 U.S.C. 154(b) by 343 days.

(21) Appl. No.: 12/203,434

(22) Filed: Sep. 3, 2008

(65) Prior Publication Data

US 2010/0054977 A1 Mar. 4, 2010

(51) Int. Cl.
*F04C 2/10* (2006.01)

(52) U.S. Cl. ..... 418/26; 418/19; 418/61.3

(58) Field of Classification Search ..... 418/19, 418/26, 61.3
See application file for complete search history.

(56) References Cited

U.S. PATENT DOCUMENTS 4,413,960 A * 11/1983 Specht ..... 418/19
6,126,420 A * 10/2000 Eisenmann ..... 418/19
7,637,725 B2 * 12/2009 Berger ..... 418/61.3

* cited by examiner

*Primary Examiner*—Thomas E Denion
*Assistant Examiner*—Mary A Davis
(74) *Attorney, Agent, or Firm*—Vedder Price, P.C.

(57) ABSTRACT

A variable displacement pump includes a pump body defining first and second pools for introducing fuel/lubricant oil, and internal and external rotary members rotatably mounted on the pump body and cooperatively defining a space such that, during counterclockwise revolution, the fuel/lubricant oil is taken up from the first pool by sweeping of the space over the first pool, and is delivered to the second pool. A control slider is sleeved on the external rotary member, and has an actuated tooth moved by an expansion force in the second pool to counteract the external rotary member so as to reduce the volume of the space, thereby reducing delivery of the fuel/lubricant oil into the second pool. A biasing member is disposed to bias the actuated tooth towards the second pool.

8 Claims, 4 Drawing Sheets

VARIABLE DISPLACEMENT PUMP

BACKGROUND OF THE INVENTION

1. Field of the Invention

This invention relates to a variable displacement pump, more particularly to a variable displacement pump for pressurization of fuel/lubricant oil to be supplied into an engine.

2. Description of the Related Art

A conventional oil pump is employed to supply fuel/lubricant oil into an engine in a vehicle system, and generally includes an internal rotary member and an external rotary member which are driven by the engine to rotate so as to pump the fuel/lubricant oil into the engine. The lubrication requirements of the component parts of the engine vary with the operation speed of the engine, and the variation in the lubrication requirements and the variation in the rotational speed of the engine are generally nonlinear. For example, when the rotational speed is increased, the lubrication requirement is decreased, thereby resulting in an over supply of fuel/lubricant oil into the engine. Thus, a variable displacement pump is proposed as a fuel/lubricant oil pump.

A conventional variable displacement pump is disclosed in WO 2007/087704, which includes a control slider, an engine control unit (ECU), and a biasing member. When the pressurized fuel/lubricant oil has a relatively higher pressure, the control slider is actuated to move by means of an electrical control of the ECU so as to reduce the supply of fuel/lubricant oil. When the pressure of the pressurized fuel/lubricant oil is lowered to a predetermined value, the control slider is urged by the biasing member to return to its original state. Thus, fuel/lubricant oil can be supplied as the lubrication requirement of the engine.

Another type of the conventional variable displacement pump includes a control slider which is displaced in accordance with the working pressure of the pressurized fuel/lubricant oil, and a biasing member. However, since there are many clearances around the biasing member, the pressurized fuel/lubricant oil tends to flow into the clearances and accumulates therein, which may adversely affect the operation of the biasing member to result in unsteady operation of the pump.

SUMMARY OF THE INVENTION

An object of the present invention is to provide a variable displacement pump with enhanced operational stability.

According to this invention, the variable displacement pump includes a pump body having a bore adapted to accommodate a rotary shaft, a first sunken pit forming a first pool for introducing fuel/lubricant oil, a second sunken pit forming a second pool for collecting pressurized fuel/lubricant oil, and a dug-out having first and second slidably retaining walls which are disposed at opposite sides of the bore, and which are respectively ahead of and behind the second pool in terms of a counterclockwise direction. An internal rotary member is adapted to be rotated with the rotary shaft. An external rotary member surrounds the internal rotary member, and has an inner wall surface having an inner peripheral contour which is dragged by the internal rotary member to revolve therewith. The external and internal rotary members cooperatively define a space with a variable volume such that, during each revolution of the internal rotary member in the counterclockwise direction, the fuel/lubricant oil is taken up from the first pool by virtue of sweeping of the space over the first pool, and is subsequently delivered as pressurized fuel/lubricant oil to the second pool, and such that an increase in speed of revolution of the internal rotary member results in delivery of an increased volume of the pressurized fuel/lubricant oil to the second pool, thereby generating a force of expansion in the second pool.

The variable displacement pump further includes a control slider which has a sleeve body fittingly sleeved on the external rotary member and in pivotable engagement with the second slidably retaining wall, and an actuated tooth extending radially from the sleeve body towards the second pool. The actuated tooth is moved by the expansion force to an expanded position, where the sleeve body is strained by virtue of the pivotable engagement to counteract the dragged revolution of the external rotary member so as to reduce the volume of the space, thereby reducing delivery of the fuel/lubricant oil to the second pool.

The variable displacement pump further includes a biasing member disposed at an opposite side of the actuated tooth relative to the second pool to bias the actuated tooth away from the expanded position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
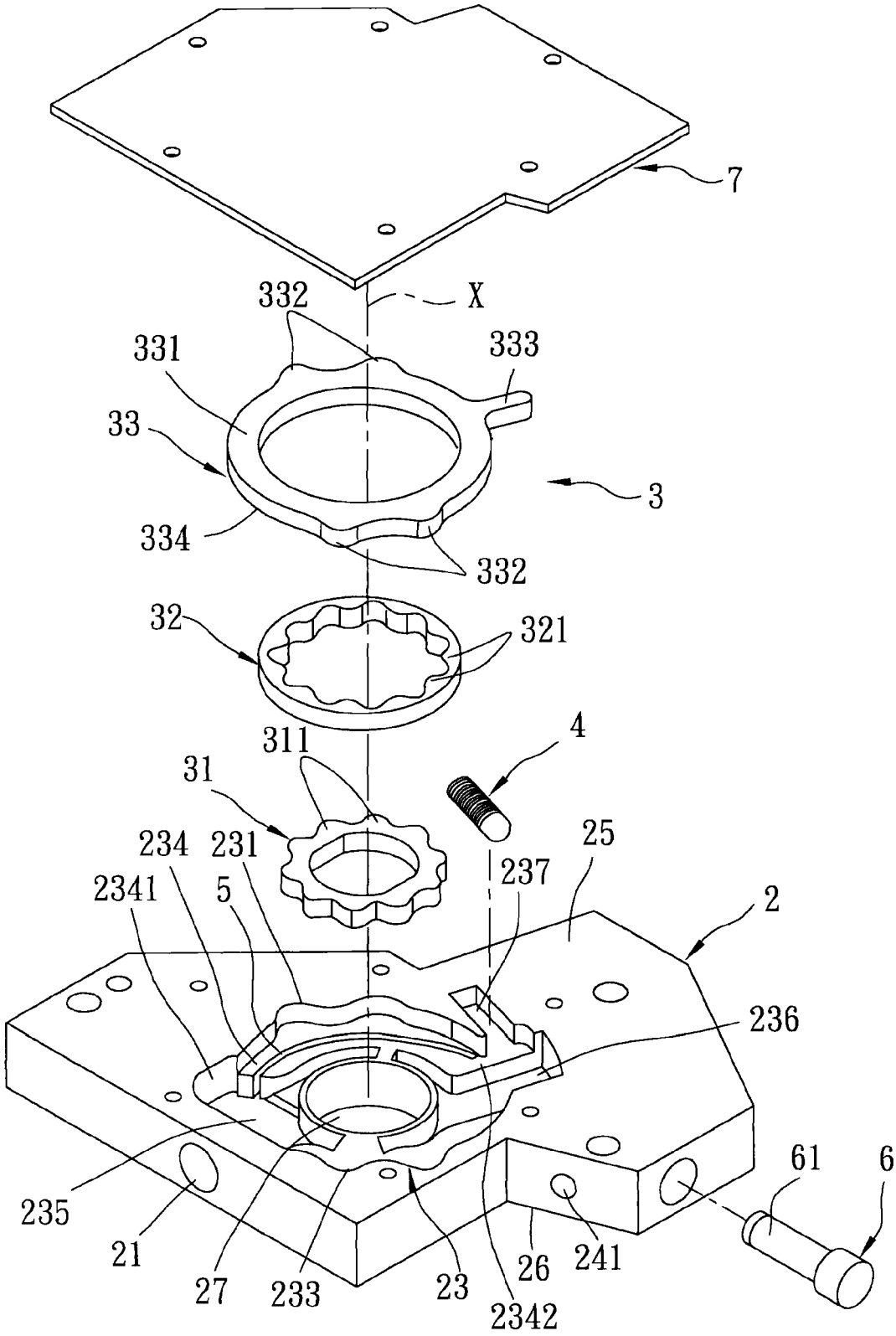
FIG. 1 is an exploded perspective view of the preferred embodiment of a variable displacement pump according to this invention.

Before the present invention is described in greater detail, it should be noted that same reference numerals have been used to denote like elements throughout the specification.

Figure 2:
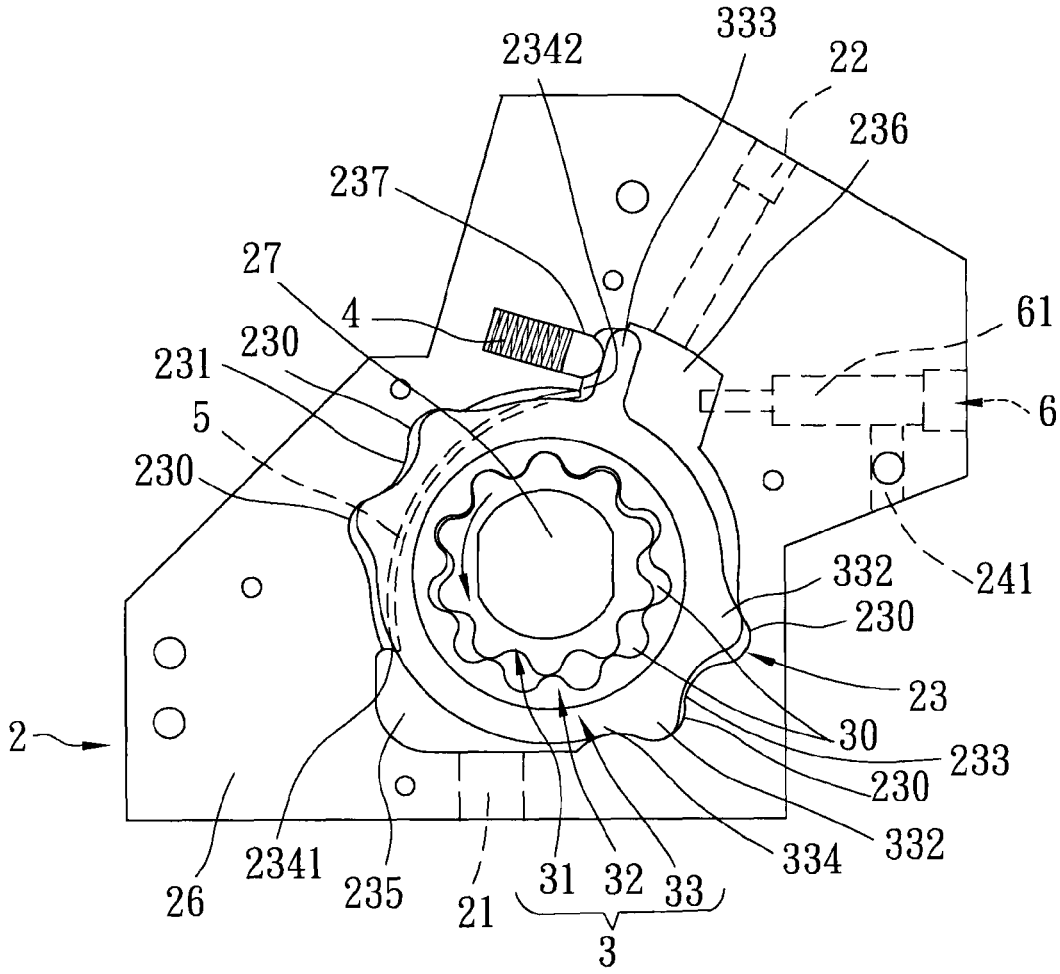
FIG. 2 is a schematic top view of the preferred embodiment, with a cover plate removed.

Referring to FIGS. 1 and 2, the preferred embodiment of a variable displacement pump according to the present invention is shown to comprise a pump body 2, a rotary unit 3, a biasing member 4, a drainage channel 5, an overpressure relief valve 6, and a cover plate 7.

The pump body 2 has upper and lower major surfaces 25,26 opposite to each other along a rotating axis (X). The upper major surface 25 has a bore 27 which extends through the lower major surface 26, and which is adapted to accommodate a rotary shaft (not shown) that is rotated about the rotating axis in a counterclockwise direction by an engine (not shown). A first sunken pit 235 is disposed on a trailing side in terms of the counterclockwise direction, and extends towards the lower major surface 26 to form a first pool 235 for introducing fuel/lubricant oil through an inlet 21. A second sunken pit 236 is disposed on a leading side in terms of the counterclockwise direction, and extends towards the lower major surface 26 to form a second pool 236 for collecting pressurized fuel/lubricant oil, which is supplied to the engine through an outlet 22.

The pump body 2 further has a dug-out 23 extending from the upper major surface 25 towards the lower major surface 26. The dug-out 23 has first and second slidably retaining walls 231,233 which are disposed at the opposite sides of the bore 27, and which are respectively ahead of and behind the second pool 236 in terms of the counterclockwise direction. The first and second slidably retaining walls 231,232 respectively have two pairs of loosely anchoring recesses 230 disposed opposite to each other. In addition, the dug-out 23 extends towards the lower major surface 26 to form a platform 234 which is disposed angularly about the bore 27 and adjacent to the first slidably retaining wall 231, and which is elongated to terminate at unpressurized-side and pressurized-side regions 2341,2342 that respectively border the first and second pools 235,236. A recess 237 is formed in the pressurized-side region 2342 and is fluidly communicated with the second pool 236.

The rotary unit 3 includes an internal rotary member 31, an external rotary member 32, and a control slider 33.

The internal rotary member 31 is adapted to be rotated with the rotary shaft, and has an outer peripheral contour with a plurality of teeth 311.

The external rotary member 32 is disposed to surround the internal rotary member 31, and has an inner wall surface with a plurality of teeth 321, and a circular outer wall surface radially opposite to the inner wall surface. The inner wall surface has an inner peripheral contour which is partially meshed with and which is dragged by the outer peripheral contour of the internal rotary member 31 to permit revolution of the external rotary member 31 with the internal rotary member 31, and which is configured to cooperate with the outer peripheral contour to define a space 30 with a variable volume. Thus, during each revolution of the internal rotary member 31 in the counterclockwise direction, fuel/lubricant oil is taken up from the first pool 235 by virtue of sweeping of the space 30 over the first pool 235, and is subsequently delivered as pressurized fuel/lubricant oil to the second pool 236. Moreover, revolution of the internal and external rotary members 31,32 at an increased speed results in delivery of an increased volume of the pressurized fuel/lubricant oil to the second pool 236, thereby generating a force of expansion in the second pool 236.

The control slider 33 includes a sleeve body 331, an actuated tooth 333, and two pairs of loosely anchored protrusions 332.

The sleeve body 331 is fittingly sleeved on the external rotary member 32, and is configured to be in pivotable engagement with the second slidably retaining wall 233 at a pivot point 334. The sleeve body 331 has a surrounding bottom surface 334 which is configured to shiftably rest on the platform 234 so as to interrupt fluid communication between the pressurized-side and unpressurized-side regions 2342, 2341 along the platform 234.

The actuated tooth 333 extends radially from the sleeve body 331 towards the second pool 236 such that the pressurized-side region 2342 is disposed at the opposite side of the actuated tooth 333 relative to the second pool 236.

The loosely anchored protrusions 332 extend radially from the sleeve body 331, and are disposed to engage the loosely anchoring recesses 230, respectively, so as to limit the extent of pivoting movement of the sleeve body 33.

The biasing member 4 is disposed in the recess 237 so as to bias the actuated tooth 333 towards the second pool 236.

In this embodiment, the drainage channel 5 is formed in the platform 234, and extends to fluidly communicate the pressurized-side region 2342 with the unpressurized-side region 2341.

The overpressure relief valve 6 is disposed in the pump body 2, and has a piston 61 which is actuated, in response to a predetermined excessive pressure in the second pool 236, to be opened so as to discharge an excess of the pressurized fuel/lubricant oil through a relief port 241.

The cover plate 7 is secured on the upper major surface 25 of the pump body 2 to cover the bore 27, the first and second sunken pits 235,236, and the dug-out 23.

Figure 3:
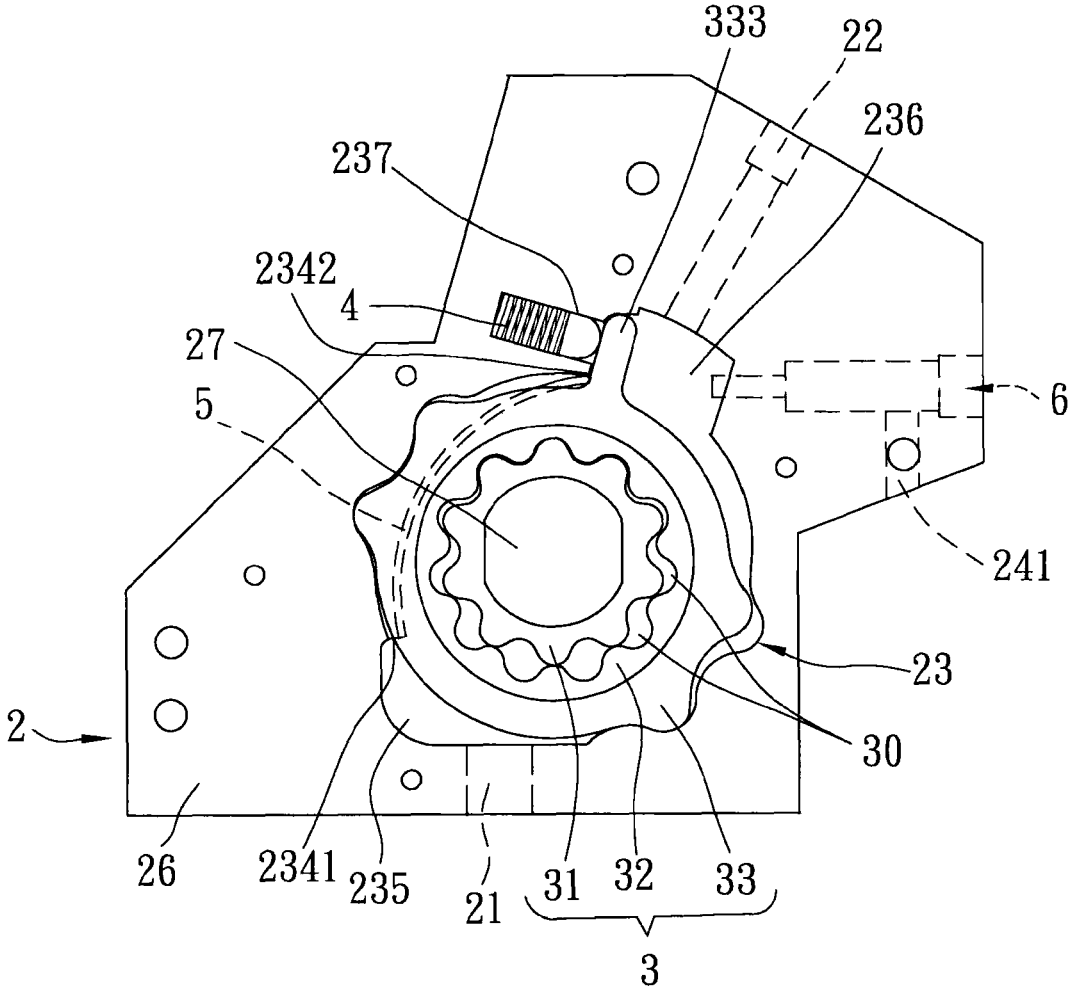
FIG. 3 is a schematic top view of the preferred embodiment when a control slider is in an expanded position.

With reference to FIGS. 1 to 3, during use, when the rotational speed of the engine is increased, the speed of the revolution of the internal rotary member 31 increases, and the volume of the pressurized fuel/lubricant oil in the second pool 236 is increased, thereby generating the expansion force. At this time, the actuated tooth 333 can be moved by the expansion force to an expanded position, as shown in FIG. 3, where the actuated tooth 333 is moved towards the pressurized-side region 2342 against the biasing action of the biasing member 4, and where the sleeve body 33 is strained by virtue of the pivotable engagement to counteract the dragged revolution of the external rotary member 32 so as to reduce the volume of the space 30, thereby reducing delivery of the fuel/lubricant oil into the second pool 236.

Once the rotational speed of the engine is decreased to reduce the volume of the pressurized fuel/lubricant oil in the second pool 236, the actuated tooth 333 is urged by the biasing member 4 back to its original position, as shown in FIG. 2.

It is noted that a clearance exists between the control slider 33 and the dug-out 23 so that the pressurized fuel/lubricant oil may flow into the recess 237. By providing the drainage channel 5, the fuel/lubricant oil in the recess 237 can be re-directed to the first pool 235 therethrough due to the counterclockwise revolution of the internal and external rotary members 31,32. Thus, accumulation of the fuel/lubricant oil in the recess 237 can be prevented, thereby eliminating the problems associated with the aforesaid prior art.

Moreover, excess fuel/lubricant oil can be discharged through the overpressure relief valve 6 to prevent overpressure in the second pool 236.

Figure 4:
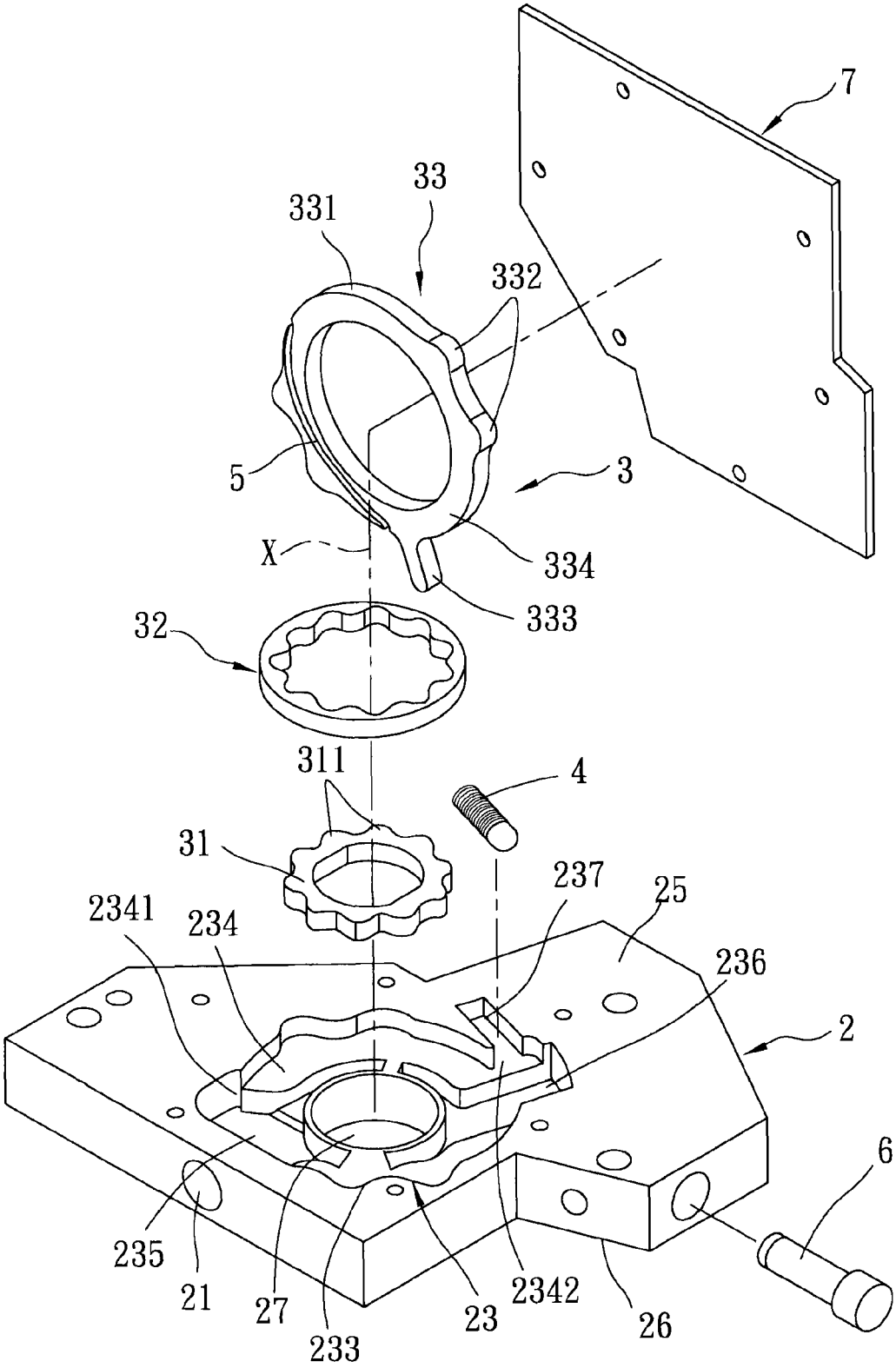
FIG. 4 is an exploded perspective view of another preferred embodiment of a variable displacement pump according to this invention.

Referring to FIG. 4, another preferred embodiment of a variable displacement pump according to this invention is shown to be similar to that of the aforesaid embodiment in construction, except that the drainage channel 5 is formed in the surrounding bottom surface 334 of the sleeve body 33.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A variable displacement pump for pressurization of fuel/lubricant oil to be supplied into an engine, comprising:

a pump body having upper and lower major surfaces opposite to each other along a rotating axis, said upper major surface having a bore which extends through said lower major surface, and which is adapted to accommodate a rotary shaft that is rotatable about the rotating axis in a counterclockwise direction, a first sunken pit which is disposed on a trailing side in terms of the counterclockwise direction, and which extends towards said lower major surface to form a first pool for introducing the fuel/lubricant oil, a second sunken pit which is disposed on a leading side in terms of the counterclockwise direction, and which extends towards said lower major surface to form a second pool for collecting pressurized fuel/lubricant oil, and a dug-out extending towards said lower major surface, and having first and second slidably retaining walls which are disposed at the opposite sides of said bore, and which are respectively ahead of and behind said second pool in terms of the counterclockwise direction;

an internal rotary member which is adapted to be rotated with the rotary shaft, and which has an outer peripheral contour;

an external rotary member which is disposed to surround said internal rotary member, and which has inner and outer wall surfaces radially opposite to each other, said inner wall surface having an inner peripheral contour which is dragged by said outer peripheral contour to permit revolution of said external rotary member with said internal rotary member, and which is configured to cooperate with said outer peripheral contour to define a space with a variable volume such that, during each revolution of said internal rotary member in the counterclockwise direction, fuel/lubricant oil is taken up from said first pool by virtue of sweeping of said space over said first pool, and is subsequently delivered as pressurized fuel/lubricant oil to said second pool, and such that an increase in speed of revolution of said internal rotary member results in delivery of an increased volume of the pressurized fuel/lubricant oil to said second pool, thereby generating a force of expansion in said second pool;

a control slider including a sleeve body which is fittingly sleeved on said external rotary member, and which is configured to be in pivotable engagement with said second slidably retaining wall, and an actuated tooth which extends radially from said sleeve body towards said second pool such that said actuated tooth is moved by virtue of the expansion force to an expanded position, where said sleeve body is strained by virtue of the pivotable engagement to counteract the dragged revolution of said external rotary member so as to reduce the volume of said space, thereby reducing delivery of the pressurized fuel/lubricant oil to said second pool; and a biasing member which is disposed at an opposite side of said actuated tooth relative to said second pool to bias said actuated tooth away from the expanded position.

2. The variable displacement pump according to claim 1, wherein said dug-out extends towards said lower major surface to form a platform which is disposed angularly about said bore and adjacent to said first slidably retaining wall, and which is elongated to terminate at unpressurized-side and pressurized-side regions that respectively border said first and second pools, said pressurized-side region being disposed at the opposite side of said actuated tooth relative to said second pool such that said actuated tooth is moved by virtue of the expansion force towards said pressurized-side region to the expanded position, and said sleeve body having a surrounding bottom surface which is configured to shiftably rest on said platform so as to interrupt fluid communication between said pressurized-side and unpressurized-side regions along said platform.

3. The variable displacement pump according to claim 2, further comprising a drainage channel which is formed between said platform and said surrounding bottom surface of said sleeve body, and which extends to fluidly communicate said pressurized-side region with said unpressurized-side region.

4. The variable displacement pump according to claim 3, wherein said drainage channel is formed in said platform.

5. The variable displacement pump according to claim 3, wherein said drainage channel is formed in said surrounding bottom surface of said sleeve body.

6. The variable displacement pump according to claim 3, wherein said first and second slidably retaining walls respectively have loosely anchoring recesses which are disposed opposite to each other, said control slider including loosely anchored protrusions which extend radially from said sleeve body and which are disposed to engage said loosely anchoring recesses, respectively, so as to limit extent of pivoting movement of said sleeve body.

7. The variable displacement pump according to claim 3, further comprising an overpressure relief valve which is disposed to be actuated, in response to a predetermined excessive pressure in said second pool, so as to discharge an excess of the pressurized fuel/lubricant oil.

8. The variable displacement pump according to claim 1, further comprising a cover plate disposed on said upper major surface to cover said bore, said first and second sunken pits, and said dug-out.

* * * * *